United States Patent [19]

Bortolloni et al.

[11] Patent Number: 4,861,949

[45] Date of Patent: Aug. 29, 1989

[54] CAM SWITCH FORMED BY MODULAR UNITS

[75] Inventors: Sergio Bortolloni; Glauco M. Bernier, both of Milan, Italy

[73] Assignee: Breter S.p.a., Paderno Dugnano, Italy

[21] Appl. No.: 123,883

[22] Filed: Nov. 23, 1987

[30] Foreign Application Priority Data

Jul. 26, 1987 [IT] Italy ..... 21094 A/87

[51] Int. Cl.[4] ..... H01H 9/02

[52] U.S. Cl. ..... 200/5R; 200/68; 200/307

[58] Field of Search ..... 200/4, 5 R, 14, 17 R, 200/18, 16 A, 153 L, 153 LA, 153 LB, 307, 6 B

[56] References Cited

U.S. PATENT DOCUMENTS 2,912,527 11/1959 Naimer ..... 200/18 X 4,335,288 6/1982 Ludwig et al. ..... 200/307

*Primary Examiner*—A. D. Pellinen

*Assistant Examiner*—Morris Ginsburg

*Attorney, Agent, or Firm*—Laff, Whitesel, Conte & Saret

[57] ABSTRACT

A swich comprises pack-aligned switching units 9, each provided with fixed 30 and movable contacts 36 operable by a cam shaft 11 rotatably passing through the switching units 9 to close and break electric circuits to which said contacts lead off. The shaft is supported, at one free end thereof, by a terminal closure element 10 fixed to the switching units 9 and is connected, at its opposed end, to a trip mechanism 12 located in a trip unit 8 fastened to said switching units. The switching units, trip unit and terminal closure element constitute each a modular unit engageable with other modular units by restrained fixing and disengageable therefrom without bringing about the disassembly and division of said unit into its component parts. The cam shaft is comprised of several hub-shaped elements 40 consecutively engaged in a rotational direction and associated each with a switching unit.

11 Claims, 4 Drawing Sheets

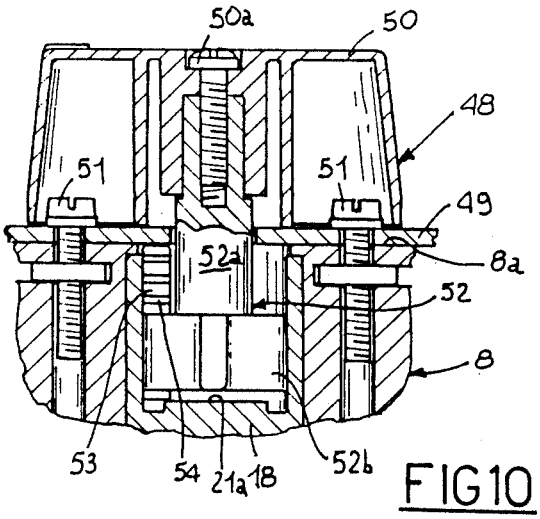
FIG10
FIG12
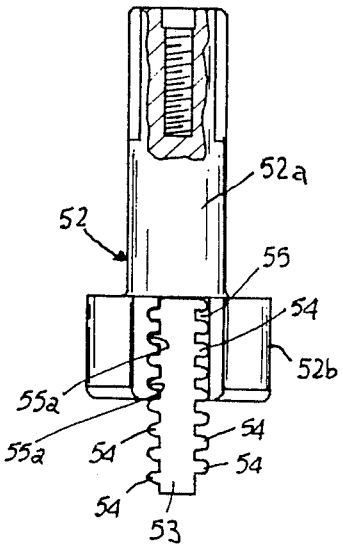
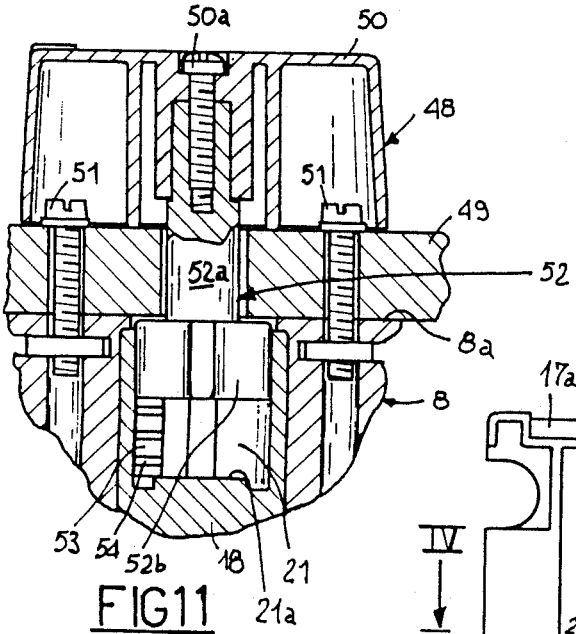
FIG11
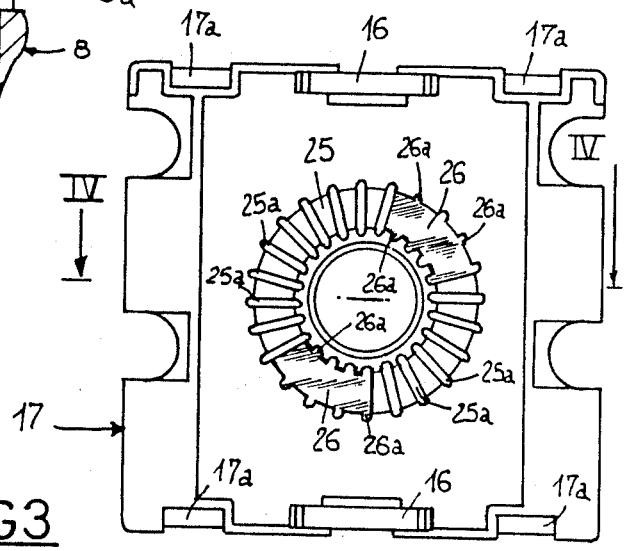
FIG3

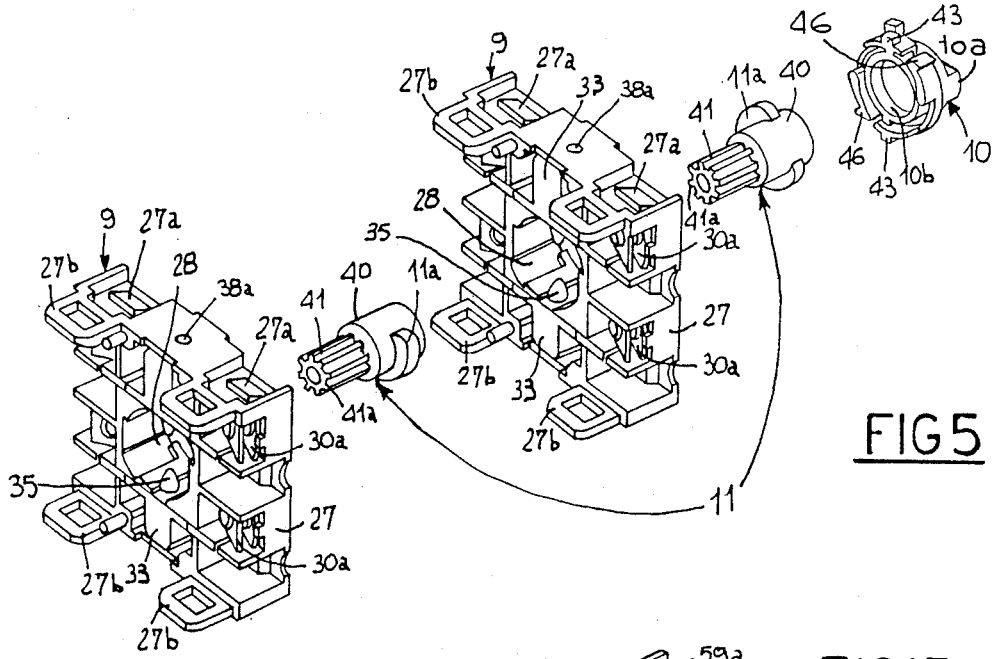
FIG5
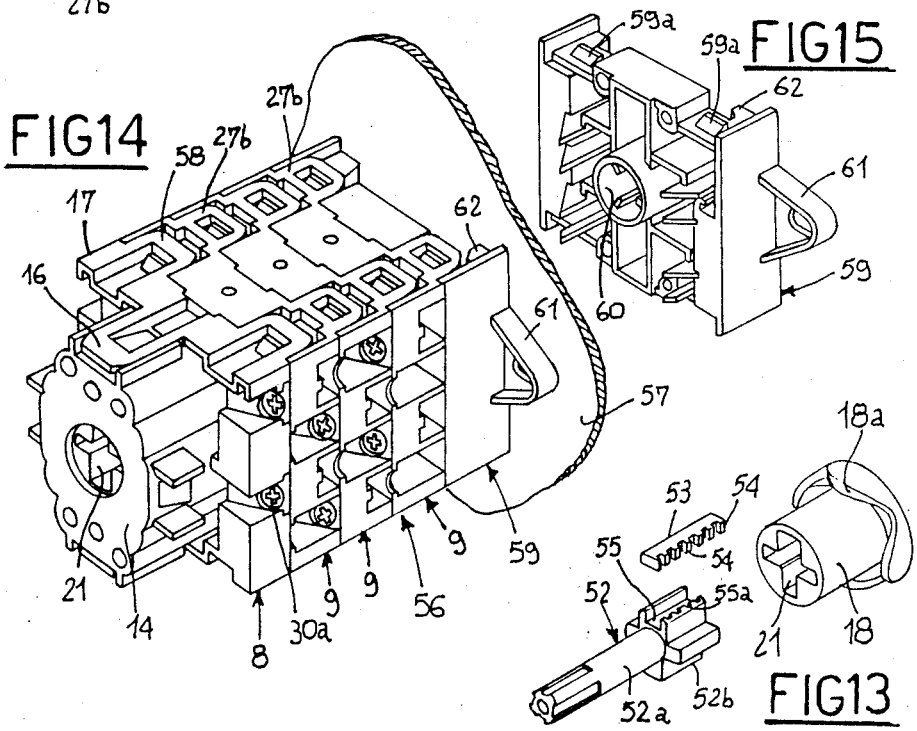
FIG15
FIG14
FIG13

CAM SWITCH FORMED BY MODULAR UNITS

BACKGROUND OF THE INVENTION

1. Field of the Invention

The present invention relates to a cam switch of the type comprising an operating member provided with a rotary coupling shank; a trip unit housing a trip mechanism operatively connected to the coupling shank; a number of pack-aligned switching units contiguously fixed to the trip unit and each provided with contact means comprising fixed and movable contacts, the latter being movable, in opposition to the action exerted by counter springs, from a closure position in which the movable contacts come in contact with the fixed contacts and a break condition in which the movable contacts are spaced apart from the fixed contacts; a drive shaft operatively connected to said trip mechanism and provided with a rotating motion by the coupling shank in order to cause the translation of the movable contacts through cams associated therewith and a terminal closure element fixed to the switching unit opposite the trip unit and rotatably supporting the drive shaft at one free end thereof.

2. Prior Art

It is known that cam switches substantially comprise a number of consecutively pack-aligned switching units provided each with two or more pairs of fixed contacts leading off to respective electric circuits, and movable contacts designed to act on the fixed contacts to selectively close and break the above mentioned electric circuits.

The operation of the fixed contacts is performed by a drive shaft rotatably engaged through the switching units and provided with a plurality of cams. Each of said cams is associated with a switching unit in order to produce, due to the rotation motions imparted to the drive shaft, the translation of the movable contacts from a closure condition in which the movable contacts are in contact with the fixed contacts to a break condition in which the movable contacts are suitably spaced apart from the fixed contacts. The above mentioned translation takes place in opposition to the action carried out by countersprings acting on the movable contacts. One end of the drive shaft is rotatably supported by a terminal closure element fastened to the switching units and its opposite end is operatively engaged with a trip mechanism being part of a trip unit secured to the switching units on the opposite end of the terminal element. The trip unit substantially acts such as to give the drive shaft predetermined angular positionings when the latter is rotated by means of suitable manually or electrically actuated operating members.

Currently the switching units, trip unit and terminal closure element are mutually engaged, in pack-alignment, by means of two or more threaded tie rods extending through the same over the whole length of the pack. The length of said tie rods must therefore be calculated depending upon the whole pack length which can undergo very wide variations depending on the number of the switching units forming the switch. This factor involves many problems resulting from the fact that it is necessary to accomplish many types of tie rods having different lengths each of them being fit for the assembly of a specific switch.

Traditional switches also have several further drawbacks due to the fact that the drive shaft arranged therein is of one piece construction. Therefore, as in the case of the tie rods, the length of the drive shaft must be calculated depending on the whole switch length.

In addition in many cases the length of the drive shaft must also be calculated depending on the thickness of the support panel to which the switch has to be fastened. This is for example the case of a drive shaft extending beyond the switch so that it may rotatably cross the support panel and engages a knob or the like allowing the switch to be operated.

Therefore at the present state of the art it is also necessary to manufacture many drive shafts having different lengths in order to meet the different requirements concerning operation and installation.

The presence of the above described tie rods and drive shaft also involves some problems when a switch has to be modified, for example by the addition or removal of one or more switching units. In this case, together with the addition or removal of the switching units, it is also necessary to carry out the replacement of the drive shaft and tie rods.

Moreover and above all, still referring to the above mentioned necessary modifications, it is to be noted that, as a result of the structure of current switches, the removal of the tie rods brings about the whole diassembly of the switch, as regards both the mutual connection between trip unit, switching units and terminal element and the connection between the single elements forming the trip and switching units. In this connection it must be in fact pointed out that a stable positioning of these elements is achieved only when the switch is thoroughly assembled and it is therefore subjected to be impaired when either the switching units or trip unit to which said elements belong are severed from the adjoining units.

For the above reasons it has not proved to be convenient till now to alter an existing switch by adding switching units thereto or removing them therefrom and/or by replacing the trip unit and the closure element.

SUMMARY OF THE INVENTION

It is the primary object of the present invention to solve all drawbacks mentioned with reference to prior art.

The foregoing and still further objects that will become more apparent in the course of the description are substantially achieved by a cam switch wherein the trip unit, switching units and terminal closure elements constitute each a modular unit, each one of said modular units being engageable with an adjoined modular unit by restrained fixing and disengageable therefrom while maintaining said trip mechanism and contact means in their assembled condition.

BRIEF DESCRIPTION OF THE DRAWINGS

Further features and advantages will become more apparent from the detailed description of preferred embodiments of a cam switch according to the present invention, given hereinafter by way of non limiting example with reference to the accompanying drawings, in which:

FIG. 3 shows the closure portion of the trip unit seen in elevation from the side facing the inside of the trip unit;

FIG. 5 is an exploded perspective view showing the switching units, drive shaft and terminal closure element of the switch of Figl 1;

FIG. 10 is a sectional view showing an alternative embodiment of the operating member of the switch as seen in FIG. 1, in engagement relation with a thin support panel;

FIG. 11 is a variant of the preceding figure, in which the switch is in engagement relation with a thick support panel;

FIG. 12 shows a detail of the operating member as shown in FIG. 10, seen from an uprightly opposed direction;

FIG. 13 is a perspective exploded view of the detail shown in FIG. 12 and of a trip bush provided in the trip unit;

FIG. 14 is a perspective view showing an alternative embodiment of the switch in question;

FIG. 15 is a perspective view of the terminal closure element of the switch as shown in FIG. 14.

DESCRIPTION OF THE PREFERRED EMBODIMENTS

Figure 1:
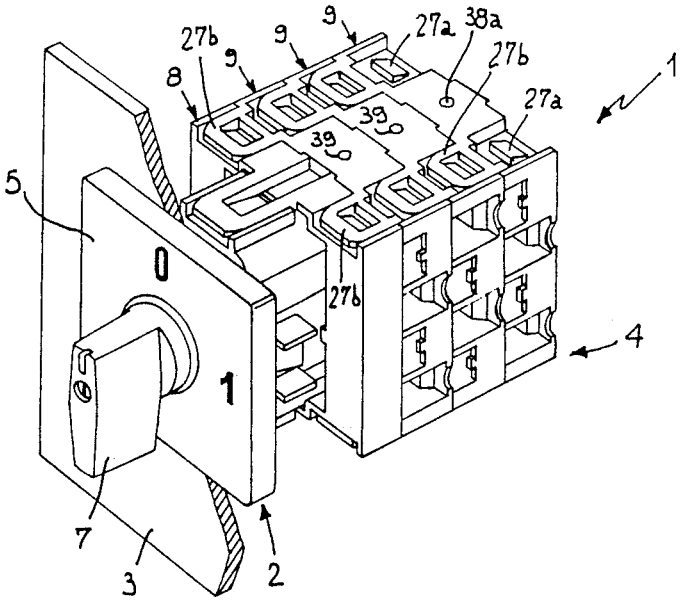
FIG. 1 is a perspective view of a cam switch in its use conditions.

Referring to the drawings and in particular to FIG. 1, a cam switch in accordance with the present invention has been globally identified by reference numeral 1.

Summarily the switch 1 substantially consists of an operating group 2 engaged to a support panel 3 and a contact block generally identified by 4, which in the embodiment shown in FIG. 1 is directly fastened to panel 3.

Figure 2:
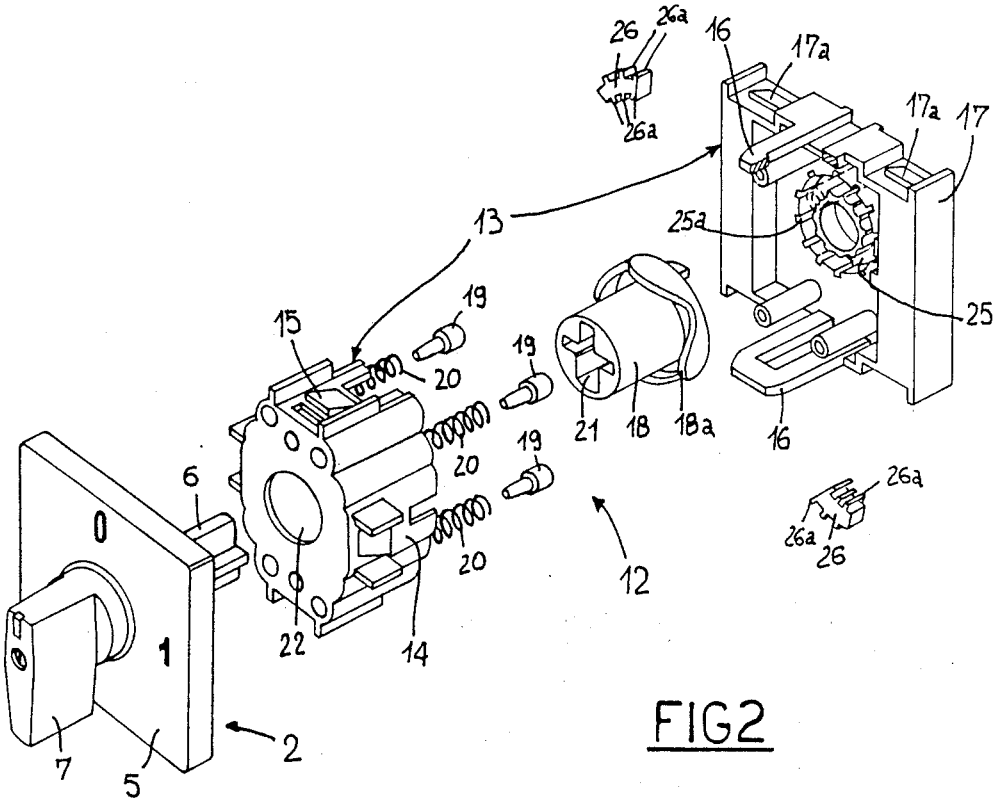
FIG. 2 is an exploded perspective view showing the trip unit and the control group included in the switch of FIG. 1.

As shown in FIGS. 1 and 2, the operating group 2 is comprised of a front plate 5 fastened to panel 3 and to which a coupling shank 6 is rotably connected; the latter is rotated by a knob 7 integral thereto and rotatably crossing the panel 3 to transmit to the contact block 4 the commands imparted by the operator through the knob.

Briefly, the contact block 4 is substantially formed with a trip unit 8 conventionally fastened by means of threaded members to the panel 3, a plurality of pack-aligned switching units 9 consecutively fastened to the trip unit 8, and a terminal closure element 10 fixed to the switching unit 9 located on the opposite side with respect to the trip unit 8.

The switching units 9 are rotatably passed through by a drive shaft 11 supported, at one end thereof, by the terminal element 10 and engaged, at the opposite end thereof, with a trip mechanism 12 provided in the trip unit 8, the shaft being thereby operated according to suitable angular rotations about its own axis due to the operation of knob 7.

In accordance with the present invention the trip unit 8, switching units 9 and closure element 10 are advantageously made such as to form each a single modular unit engageable by restrained fixing to an adjoining modular unit and disengageable therefrom without bringing about the disassembly of the various elements it is comprised of.

To this end, the trip unit 8 in an original manner comprises a housing 13 completely enclosing the trip mechanism 12. The housing 13 is formed with a box-shaped portion 14 accommodating the trip mechanism 12, to which a closing portion 17 is rigidly engaged by restrained fixing through hooking meand identified at 15 and 16 respectively; the closing portion 17 extends at least partially in front of an open side of the box-shaped portion in order to enclose the trip mechanism within the box-shaped portion. In addition the closing portion 17 is provided with hooking lugs 17a allowing the trip unit 8 to engage with the switching unit 9 contiguous thereto.

The trip mechanism 12 comprises a trip bush 18 rotatably engaged within the housing 13 and provided with a cam profile 18a on which fingers 19 and pushed against the profile by springs 20.

Figure 4:
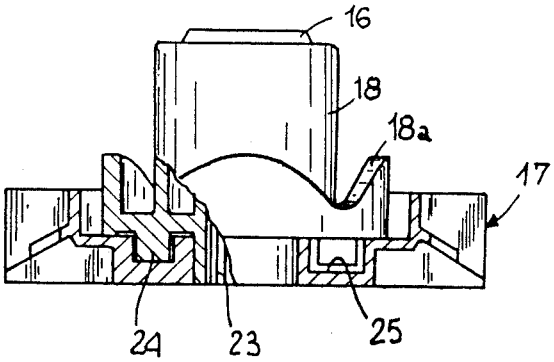
FIG. 4 is a sectional view taken along line IV—IV of the closure portion of FIG. 3 in engagement relation with a trip bush.

The bush 18 is provided with a first coupling seat 21 matching the shape of the coupling shank 6 to allow the engagement therebetween through an opening 22 formed in the box-shaped portion 14 to operate the rotation of the bush 18 itself. Due to the action of fingers 19 on the cam profile 18a, following the commands transmitted through the coupling shank 6, the bush 18 is rotated through angles of a predetermined opening. Consequently the drive shaft 11 engaged with the bush 18 in the region of a second coupling seat 23 formed in the latter (FIG. 4), undergoes predetermined angular positionings adapted to make it suitably operate the switching units 9, as more clearly shown in the following.

The trip mechanism 12 further comprises stop means acting to restrain the freedom of rotation of the bush 18 within a predetermined angle. Advantageously, in accordance with the present invention, the stop means comprises at least an abutment lug 24 located on the trip bush 18 and slidably engaging in a circular seat 25 formed within the housing 13, coaxially to the axis of rotation of the bush, and more particularly on the closing portion 17. The circular seat 25 has a number of coupling notches 25a distributed over the circumference thereof according to a predetermined pitch and it is designed to forcedly receive one or more stop elements 26 forming locating seats for the lug 24 in order to stop the angular rotations of the bush 18.

The positioning of the stop elements 26 within the circular seat 25 is fixed by clutch dogs 26a that are suitably disposed on the stop elements and engage in the corresponding coupling notches 25a. Advantageously, since the coupling notches 25a are distributed over the whole circumferential extension of the circular seat 25, by suitably positioning the stop elements 26 it is possible to restrain the freedom of rotation of the bush 18 according to any desired angular opening.

Figure 7:
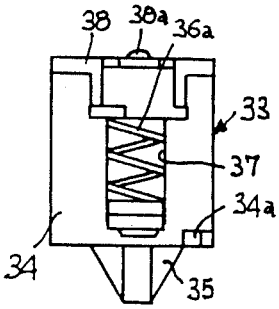
FIG. 7 is an enlarged side view of a detail of the switching unit.
Figure 6:
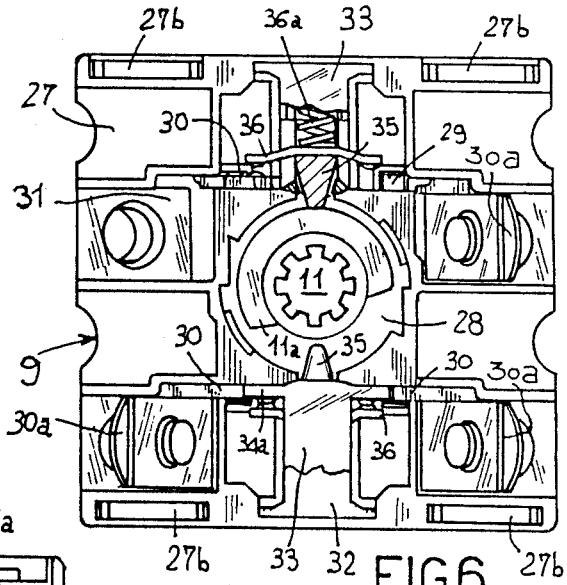
FIG. 6 is an elevation view on an enlarged scale and partially in split of one of the switching units in engagement relation with the drive shaft.
Figure 8:
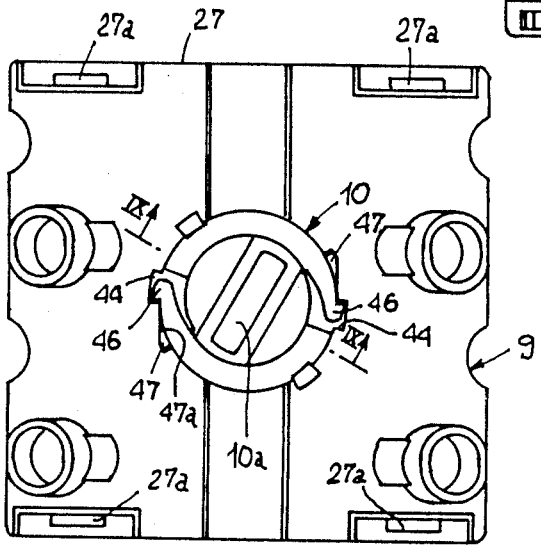
FIG. 8 shows the switching unit seen from the opposite side with respect to FIG. 6 and in engagement relation with the terminal closure element.

Referring particularly to FIGS. 5, 6 and 7, each switching unit 9 comprises a casing 27 provided with a central opening 28 through which the drive shaft 11 extends and externally provided with hooking lugs 27a similar to the hooking lugs 17a exhibited by the trip unit 8, as well as with hooks 27b forwardly extending therefrom. For the mutual engagement of the switching units 9 the hooks 27*b* of each of the latter engage the next switching unit in the region of the hooking lugs 27*a* thereof. Likewise, the switching unit 9 located on the side of the trip unit 8 makes its hooks 27*b* match with the hooking lugs 17*a*.

Within the casing 27 there are first housings 29, each of them forcedly receiving a fixed contact 30 with which a connecting terminal 30*a* is associated in order to allow the connection between the fixed contact and an electric circuit. As clearly appears from the figures, in the example shown each switching unit is provided with two pairs of fixed contacts 30, each pair connected to the opposite poles of an electric circuit.

Terminals 30*a* are housed in respective spaces 31 substantially consisting, as known, of two plate-like elements adapted to come close to each other by the action of a threaded element reachable through an opening formed in the casing 27.

Also formed in the casing 27 are two second housings 32 located opposite each other, each of them forcedly accommodating an envelope 33. The envelope 33 consists of a guide portion 34 along which a tappet member 35 slides, coming out of the latter so that it comes in contact with the profile of a ca*m* 11a arranged on the drive shaft 11. The tappet member 35 supports a movable contact 36 coming out on either side of the guide portion 34 through elongated holes 37 formed therein, so that it overlaps the respective fixed contacts.

Due to the rotational motions imparted to the drive shaft as above described, as a result of the action of the tappet member 35 on the cam 11a, the movable contact 36 carries out translations and it is consequently brought from a closure condition, in which its opposed ends touch the fixed contacts 30, to a break condition in which the movable contact is spaced apart from the fixed contacts. The translations from a closure condition to a break condition take place against the action exerted by the counter-spring 36*a* housed in the envelope 33 and acting between the movable contact and a closing portion 38 engaged by restrained fixing on the guide portion 34 such as to enclose the tappet element 35, movable contact 36 and counter-spring 36*a* therein.

Advantageously, in a preferred embodiment, the closing portion 38 is externally provided with a relief 38*a* adapted to engage by snap fitting with a hole 39 formed in the casing 27 to ensure the fastening of envelope 33 thereto. In addition the guide portion 34 is provided with side projections 34*a* acting each on the edge of one of the fixed contacts 30 to fix the positioning thereof.

As clearly visible in FIG. 5, the drive shaft 11 preferably consists of a number of hub-shaped elements 40, each of them exhibiting a cam 11*a* designed to operate the contacts of one of the switching units 9. On opposite sides each hub-shaped element 40 is provided with a connection shank 41 having a number of circumferentially distributed teeth 41*a* and a cylindrical grooved housing 42 (FIG. 9) matching the shape of the connection shank 41. The hub-shaped elements 40 are engageable one after the ohter in a rotation direction by inserting the shank 41 of one of them in the cylindrical grooved housing 42 of the next one. The hub-shaped element 40 associated with the switching unit 9 fastened to the trip unit 8 engages its shank 41 in the second coupling seat 23 that matches the shape of said shank and is formed in the trip bush 18, so that it is rotated by the latter.

Figure 9:
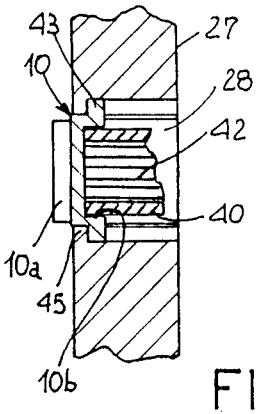
FIG. 9 is a sectional view taken along line IX—IX of FIG. 8.

The hub-shaped element 40 associated with the switching unit 9 located on the opposite side with respect to the trip unit 8 is rotatably supported, as clearly shown in FIG. 9, by the terminal closure element 10.

Advantageously, according to a further feature of the present invention, the terminal closure element 10 substantially consists of a closure plug engageable with one end of the central opening 28 exhibited by the switching unit 9 opposite the trip unit 8. In greater detail, the closure plug 10 is engageable with opening 28 through bayonet coupling means consisting of two radial lugs 43 designed to be introduced into recesses 44 obtained in the casing 27 close to the opening 28 when the plug is coaxially engaged in the opening and to engage with undercuts 45 formed in the region of the recesses 44 as a result of an angular rotation imparted to the closure plug.

The plug 10 is also provided with fitting means comprising two spring pawls 46 designed to be introduced into respective housings 47 formed close to the opening 28 when the plug is coaxially introduced thereinto and to interfere with counter-surfaces 47*a* exhibited by the housings 47 to be engaged by snap fitting with the recesses 44 due to the angular rotation imparted to the plug.

The rotation of the plug can be performed acting by a screwdriver or the like on a slot 10*a* formed outside it.

As shown in FIG. 9, a support seat 10*b* is formed on the plug surface facing the inside of the switching unit and the free end of the drive shaft 11 is rotatably housed therein.

FIGS. 10 to 13 show an alternative embodiment of the operating group associated with the contact block 4; in the figures the operating group has been globally identified by reference numeral 48.

The operating group 48 is particularly adapted to replace the previous operating groups with front plate 5, when it is provided the use of support panels 49 on which appropriate references adapted to show the operation state of the switch depending upon the positioning of the control knob are reported for example by silk-screen printing or the like.

In the operating group 48 the control knob, identified at 50, is preferably shaped so as to hide the screws 51 currently used to fasten the switch 1 to the support panel 49 in the region of the trip unit 8. The knob 50, through a screw 50*a* or the like, is secured to a coupling shank 52 the cylindrical connecting portion 52*a* of which rotatably crosses the panel 49, while a suitably shaped coupling portion 52*b* of the shank operatively engages with the first seat 21 of the trip bush 18. In an original manner a positioning insert 53 is advantageously associated with the coupling shank 52 and a number of grip pawls 54 are distributed over the former according to a predetermined pitch. The insert 53 is forcedly engageable with a groove 55 longitudinally formed in the coupling portion 52*b* and provided along one side thereof with a plurality of cavities 55*a* designed to receive the grip pawls 54.

As shown in FIGS. 10 and 11, the whole length of the insert 53 is substantially equal to the distance between a front surface 8*a* of the trip unit 8 designed to abut against the panel 49 and a locating surface 21*a* formed on the bottom of the first seat 21. Advantageously the presence of the grip pawls 54 and cavities 55*a* allows the positioning of the insert 53 to be varied along the coupling portion 52*b*. By comparing FIGS. 10 and 11 it is possible to see that the positioning is chosen depending upon the thickness of panel 49 so that in any way the opposed ends of the insert 53 will abut against the locating surface 21*a* and the surface of the support panel 49 respectively, in order to avoid undesired end plays of the knob 50.

Obviously the thickness of panel 49 can vary according to values corresponding to the distribution pitch of the grip pawls 54. According to a preferred embodiment the grip pawls 54 are distributed along both sides of the insert 53, so that grip pawls 54 disposed on one side have an offset positioning corresponding to half the value of the above mentioned pitch with resepct to the ones disposed on the other side. As a result a strict and precise adaptability of the operating member 48 to the various thicknesses of panels 49 is allowed even if the variations are of the smallest value.

In FIG. 14 an alternative embodiment of the switch contact block has been globally identified by reference numeral 56. The contact block 56 is adapted to be fastened to the bottom wall 57 of a cabinet or the like inside which the contact block is housed, instead of being secured to the support panel engaging the operating member 2.

The contact block 56 differs from the previously described contact block 4 only as regards the structure of the closure portion 17 being part of the trip unit 8, as well as the type of closing element used.

In greater detail, the closure portion 17 is provided with hooks 58 having the same structure as the hooks 27*b* located on the switching units 9, instead of exhibiting the hooking lugs 17*a*. In this way the trip unit 8 is engaged with the switching units 9 on the opposite side with respect to the previously described embodiment. By virtue of this contrivance it is possible to adapt the orientation of the switching units 9 so that the fixing screws of the terminals 30*a* may be readily accessible.

The contact block 56 is further provided with a terminal closure element 59 having a configuration similar to that of the switching units 9 and has hooking lugs 59*a* adapted to be engaged by the hooks 27*b* provided on the switching unit 9 opposite the trip unit 8. Once the closure element 59 is in engagement with the contact block 56, it supports the drive shaft 11 in the same manner as previously described, through a support seat 60 provided therein.

The closure element 59 is further provided with two or more side tabs 61 (only one of which is visible in the accompanying figures) by means of which the contact block 56 is fastened to the wall 57 through threaded members or the like.

The closure element 59 can also be provided, on its outer surface, with attachment teeth 62 allowing the contact block 57 to be fastened on DIN guides or the like.

The present invention attains the intended purposes. By the use of the switch in question it is in fact possible to eliminate all drawbacks resulting from the use, in the known art, of tie rods and the like in order to achieve the mutual engagement of the switching units, trip unit and closure element. In addition all drawbacks resulting from the presence of drive shafts of one piece construction are also eliminated.

Furthermore it is advantageously possible to add switching units 9, together with the respective hub-shaped elements, to the switch in question (or remove them therefrom) without any replacement of the construction details being required and without the presence of the drawbacks of the known art related to the complete disassembly of the contact block as a result of the removal of the tie rods.

The switch of the invention, when switching units have to be added or removed, only requires to dismantle the closure element 10, 59.

Obviously the present invention is susceptible of many modifications and variations all falling within the inventive idea characterizing it.

What is claimed is:

1. A cam switch formed by modular units comprising an operating member provided with a rotary coupling shank, a trip unit housing a trip mechanism operatively connected to the coupling shank; a number of pack-aligned switching units contiguously fixed to said trip unit and each provided with contact means comprising fixed and movable contacts, the latter being movable, in opposition to the action exerted by counter-springs, from a closure position in which the movable contacts come in contact with the fixed contacts and a break condition in which the movable contacts are spaced apart from the fixed contacts; a drive shaft operatively connected to said trip mechanism and provided with a rotating motion by said coupling shank, in order to cause the translation of said movable contacts through cams associated therewith; a terminal closure element fixed to one of said switching units opposite the trip unit and rotatably supporting the drive shaft at one free end thereof; the trip unit, switching units and terminal closure element forming each a modular unit, and being engageable with and disengageable from each other by restrained fixing, wherein each of said switching units comprises a casing with first housings, each first housing having one of said fixed contacts forcibly inserted therein, as well as second housings each accommodating an envelope, said envelope containing one of said counter-springs, one of said movable contacts and a tappet member, said tappet member operable by one of said cams to bring the movable contact from a closure condition to a break condition, said movable contact coming out of the envelope from either side thereof so that it overlaps the fixed contacts with its opposed ends.

2. The cam switch as claimed in claim 13, wherein said trip unit comprises a housing completely enclosing the trip mechanism and provided with hooking means adapted to fix the trip unit to one of the switching units, said housing comprising a box-shaped portion accommodating the trip mechanism and a closure portion longitudinally engaged with said box-shaped portion and extending at least partially in front of an open side of the box-shaped portion in order to enclose the trip mechanism inside said box-shaped portion.

3. The cam switch as claimed in claim 2, wherein said box-shaped portion and closure portion are detachably engaged with each other by restrained fixing.

4. The cam switch as claimed in claim 2, wherein said trip mechanism comprises a trip bush rotatably accommodated in said housing and stop means to restrain the freedom of rotation of the trip bush within a predetermined maximum rotation angle, said stop means comprising at least an abutment lug disposed on the trip bush and slidably engaging with a circular seat formed in said housing coaxially with the rotation axis of the trip bush and inside which stop elements are accommodated which are designed to interfere with the abutment lug in order to stop the rotation of the trip bush.

5. The cam switch as claimed in claim 4, wherein said circular seat is provided with a number of coupling notches distributed according to a predetermined pitch over the circumference thereof, with which clutch dogs arranged on said stop elements to give the latter predetermined positionings are engaged, said stop elements being detachably insertable in said circular seat.

6. The cam switch as claimed in claim 1, wherein said envelope comprises a guide portion inside which the tappet member and the movable contact are slidably guided and a closure portion engaged with the guide portion by restrained fixing, said counter-spring acting between the movable contact and the closure portion.

7. The cam switch as claimed in claim 1, wherein said drive shaft comprises a number of hub-shaped elements each of them exhibiting an operating cam and being provided, on opposite sides, with a connection shank and a cylindrical grooved housing matching the shape of the connection shank, said hub-shaped elements being engageable one after the other in a rotational direction so that each of them may operate the contact means of one of said switching units.

8. The cam switch as claimed in claim 1, wherein said terminal closure element substantially consists of a closure plug engageable with one end of an opening formed in the switching unit to accommodate the drive shaft and provided with a support seat in which the free end of the drive shaft is rotatably accommodated, said closure plug being adapted to be fastened to the switching unit through bayonet joint means cooperating with fitting means.

9. The cam switch as claimed in claim 8, wherein said bayonet joint means comprises at least two radial lugs disposed on the closure plug and designed to be introduced into recesses obtained in the switching unit to engage with undercuts formed adjacently to said recesses as a result of an angular rotation imparted to the closure plug, said fitting means having at least a spring pawl extending from the closure plug and designed to be introduced into a housing formed in the switching unit to interfere with a counter-surface exhibited by said housing and to be engaged by snap-fitting with said recesses due to the angular rotation imparted to said closure plug.

10. The cam switch as claimed in claim 1, wherein said coupling shank comprises: a coupling portion operatively engaging with the trip mechanism; a connecting portion extending from the coupling portion and rotatably passing through a support panel to rigidly engage with a control knob; a positioning insert provided with a number of grip pawls distributed over the same according to a pre-determined pitch and engageable, by forced insertion, with a groove longitudinally formed in the coupling portion and provided with cavities designed to house said grip pawls, said positioning insert exhibiting opposed ends respectively abutting against one surface of the support panel and a locating surface of the trip mechanism.

11. The cam switch as claimed in claim 10, wherein said positioning insert is provided with two series of grip pawls distributed over respective longitudinal opposed sides according to a positioning mutually offset by half the value of said pitch.

* * * * *